US009234722B2

(12) United States Patent
Rice et al.

(10) Patent No.: US 9,234,722 B2
(45) Date of Patent: Jan. 12, 2016

(54) CONVERTIBLE KNIFE/FORE GRIP FOR A FIREARM

(71) Applicant: SWITCH GRIP LLC, Massillon, OH (US)

(72) Inventors: Michael Christopher Rice, Massillon, OH (US); Torrance L. Adcock, Jr., Bethesda, MD (US)

(73) Assignee: Switch Grip LLC, Massillon, OH (US)

( * ) Notice: Subject to any disclaimer, the term of this patent is extended or adjusted under 35 U.S.C. 154(b) by 0 days.

(21) Appl. No.: 13/893,859

(22) Filed: May 14, 2013

(65) Prior Publication Data

US 2014/0230303 A1 Aug. 21, 2014

Related U.S. Application Data

(60) Provisional application No. 61/766,750, filed on Feb. 20, 2013.

(51) Int. Cl.
*F41C 23/22* (2006.01)
*F41C 27/16* (2006.01)
*F41C 23/16* (2006.01)

(52) U.S. Cl.
CPC ..... *F41C 27/16* (2013.01); *F41C 23/16* (2013.01); *F41C 23/22* (2013.01)

(58) Field of Classification Search
CPC ..... F41C 9/02; F41C 23/16; F41C 23/22
USPC ..... 42/53, 1.09, 86
See application file for complete search history.

(56) References Cited

U.S. PATENT DOCUMENTS

| | | | | | |
|---|---|---|---|---|---|
| 545,528 | A | * | 9/1895 | Paul | 42/53 |
| 1,023,741 | A | * | 4/1912 | Kreith | 42/53 |
| 1,231,058 | A | * | 6/1917 | Pansa | 42/53 |
| 2,805,507 | A | * | 9/1957 | Buquor | 42/53 |
| 5,594,967 | A | | 1/1997 | Morton et al. | |
| 7,568,304 | B1 | * | 8/2009 | Moody et al. | 42/72 |
| 2006/0162224 | A1 | | 7/2006 | Connal | |

(Continued)

FOREIGN PATENT DOCUMENTS

| | | | |
|---|---|---|---|
| CN | 1195105 | A | 10/1998 |
| DE | 3222001 | * | 12/1983 |

OTHER PUBLICATIONS http://www.m34tactical.com/raptor.html, "Raptor Dagger", printed Jun. 12, 2013, website is undated but inventor believes the website is older than May 14, 2013.

(Continued)

*Primary Examiner* — Stephen M Johnson
(74) *Attorney, Agent, or Firm* — Sand & Sebolt; Howard L. Wernow

(57) ABSTRACT

A device is convertible between a knife and a fore grip of a firearm. The device has a grip body operatively connected to a blade, and an attachment member connecting the grip body to a longitudinally extending rail of a firearm. The blade converts between an extended position when the device is disconnected from the firearm to a stored position when the device is connected the rail. The blade remains oriented along the longitudinal axis of the grip body when it is in both the stored position and the extended position. The grip body remains operatively connected to the blade when the device is disconnected from the firearm and the blade is in the extended position.

17 Claims, 9 Drawing Sheets

(56) References Cited

U.S. PATENT DOCUMENTS

| | | | | |
|---|---|---|---|---|
| 2007/0271832 | A1 | 11/2007 | Griffin | |
| 2009/0133309 | A1* | 5/2009 | Cahill | 42/72 |
| 2010/0018101 | A1* | 1/2010 | Moody et al. | 42/72 |
| 2010/0132239 | A1* | 6/2010 | Moody et al. | 42/72 |
| 2014/0215884 | A1* | 8/2014 | Adcock, Jr. | 42/72 |
| 2014/0338245 | A1 | 11/2014 | Lanasa et al. | |

OTHER PUBLICATIONS http://www.flickr.com/photos/48470964@N002/4442555408, pimpmygun.doctornoob.com, printed Jun. 12, 2013, website is undated but inventor believes the website is older than May 14, 2013 (unable to print original website as site no longer exists), 1 page.

http://flickr.com/photos/48470964@n02/4444306510/in/photostream, pimpmygun.doctornoob.com, printed Jun. 12, 2013, website is undated but inventor believes the website is older than May 14, 2013 (unable to print original website as site no longer exists), 1 page.

www.everydaynodaysoff.com/2012/07/05/bringing-a-knife-to-a-gunfight/, "Bringing a Knife to a Gunfight", author unknown, printed Jun. 12, 2013, website is undated but inventor believes the website is older than May 14, 2013.

www.amazon.com, "Kubaton 4 In. Black Keychain with Concealed Knife", printed Jun. 12, 2013, website is undated but inventor believes the website is older than May 14, 2013.

www.ar15.com, "Samson Knives for The AR15 Grip with Pics", printed Jun. 12, 2013, website is undated but inventor believes the website is older than May 14, 2013.

* cited by examiner

CONVERTIBLE KNIFE/FORE GRIP FOR A FIREARM

RELATED APPLICATIONS

This application claims the benefit of U.S. Provisional Patent Application Ser. No. 61/766,750 filed Feb. 20, 2013; the disclosure of which is incorporated herein by reference as if fully rewritten.

TECHNICAL FIELD

The present invention relates generally to gripping devices. More particularly, the present invention relates to a firearm fore grip that is convertible to a knife. Specifically, the present invention provides a blade that is housed or stored within a chamber of a grip body when the device is connected to a rail of a firearm, and the blade is exposed in an extended position when the device is disconnected from the firearm.

BACKGROUND INFORMATION

Many knives have been designed and configured for self defense and utilitarian purposes. Most of these knives comprise some type of blade attached to a grip. Some knives have even been configured to be convertible between an open and closed position, such as a pocket knife. Knives can also be used as a tool in combination with a firearm. For example, the blade can function as a hand tool, like a screw driver, for disassembling the components of the firearm.

The prior art reveals fore grips for firearms have incorporated accessories before. For example, the MVF-515 Modular Vertical Foregrip Laser Sight distributed by the Crimson Trace Corporation of Wilsonville, Oreg. provides a flashlight and a laser sight integrated into a vertical fore grip. Additionally, the STK90201 TAPCO intrafuse vertical grip distributed by The Country Shed of Roaring Spring, Pa. provides a vertical fore grip adapted to house batteries within the grip body.

However, a convertible knife has not heretofore been configured to convert between a knife and a component of a firearm. Namely, a convertible knife has never been made to convert between a knife and a vertical or angled fore grip of a firearm, wherein the fore grip remains attached to a blade when removed from the firearm. Further, there is always a need in the art for new grip devices that in addition to providing a more stable shot to improve accuracy of the firearm also stores a knife. The present invention addresses these and other issues.

SUMMARY

In one aspect, the invention may provide a grip for a firearm comprising: a grip body having first and second ends adapted to be removably mounted on a firearm, said grip body defining an interior chamber; a firearm attachment member on the first end of the grip body; and a blade, located within the interior chamber of the grip body and moveable between a stored position and an extended position.

In another aspect, an embodiment may provide an ergonomic grip having a folding blade connected to the grip via a lockable hinge capable of locking the blade in position when the blade is released from the folded confinement within the grip. The blade is fully extended and may be locked in place. A tubular recess comprises a cutout that houses the blade when the blade is folded and concealed. A release mechanism may be in the form of a compression spring with an operatively connected button or deployment member that urges an attachment member to connect or disconnect with the rail of a firearm when the button is depressed by the operator.

Another embodiment may provide a knife with a picatinny rail attachment where a clamp is attached to a grip connected to a blade. The clamp is connected to an end of the grip to operatively connect the blade to a picatinny-type rail of a firearm. Preferably, the grip is mounted to the rail positioned forwardly of the firearm trigger such that this embodiment may be used as a vertically orientated fore grip while attached to the firearm. The grip is detachable from the firearm. The blade may be concealed when attached to the firearm.

In yet another aspect, an embodiment may provide a method of converting a firearm fore grip device into a knife, when the fore grip device is attached to a rail of a firearm, comprising the steps of: providing a convertible device comprising a grip body having a first end and a second end defining a vertical direction there between, and a blade convertible between an extended position and a stored position, wherein the blade is operatively connected in a vertical orientation to the grip body in each the extended position and the stored position; disengaging a securing mechanism; removing the grip body a distance away from the firearm; and moving the blade from the stored position to the extended position.

Another aspect of an embodiment may provide the combination of, a firearm having a tactical rail and a fore grip, wherein the fore grip includes: a grip body having first and second ends adapted to be positioned forward of a trigger and removably mounted on the firearm, said grip body defining an interior chamber; a firearm attachment member on the first end of the grip body adapted to connect the grip body to the tactical rail; and a blade located within the interior chamber of the grip body and moveable between a stored position and an extended position.

BRIEF DESCRIPTION OF THE SEVERAL VIEWS OF THE DRAWINGS

A sample embodiment of the invention, illustrative of the best mode in which Applicant contemplates applying the principles, is set forth in the following description, is shown in the drawings and is particularly and distinctly pointed out and set forth in the appended claims.

Similar numbers refer to similar parts throughout the drawings.

DETAILED DESCRIPTION

Figure 1:
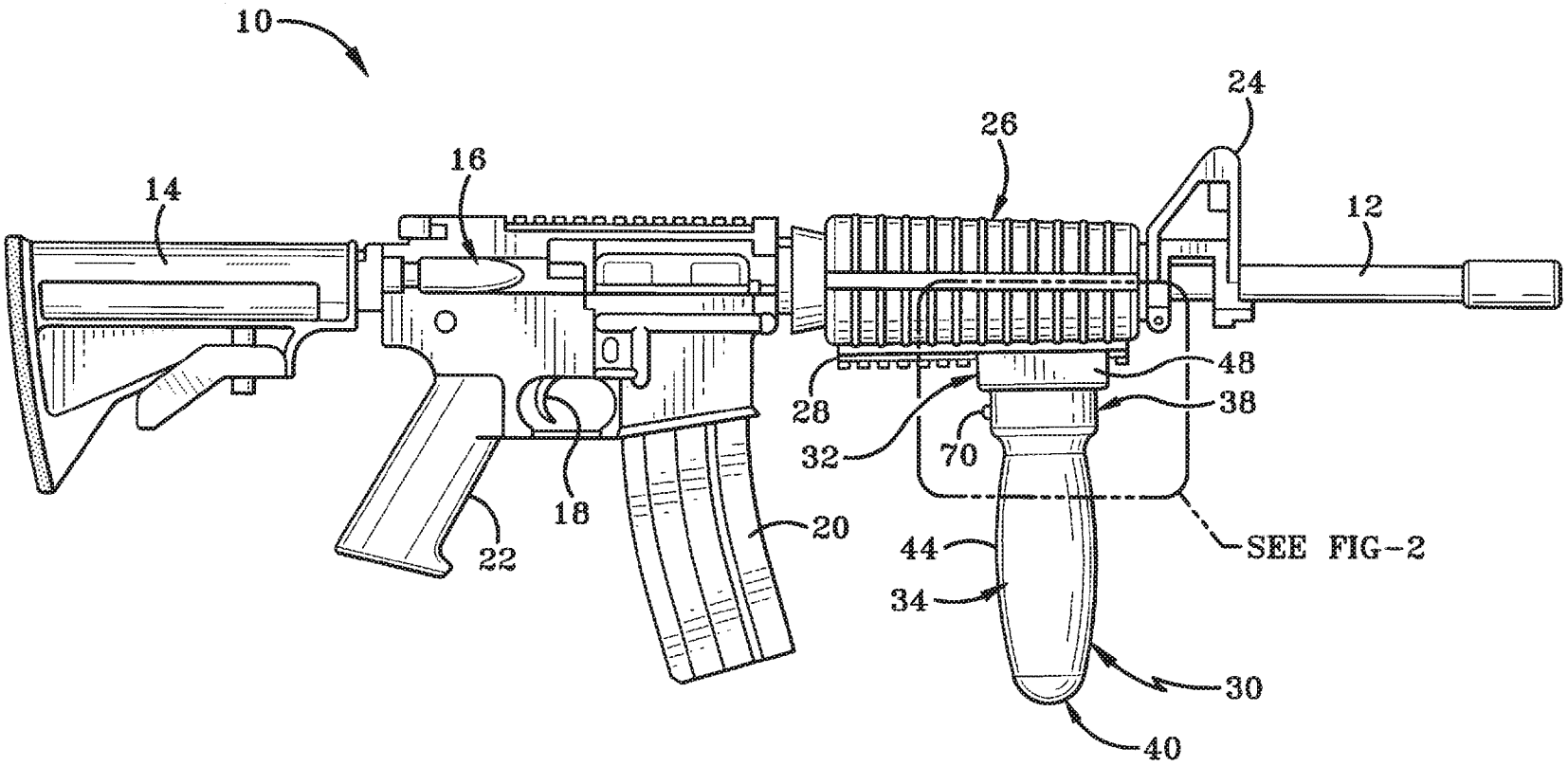
FIG. 1 is a schematic elevation view of a conventional assault rifle with a convertible knife/fore grip of the present invention attached to the rail part of the stock.

With primary reference to FIG. 1, a firearm 10 is depicted in the form of a conventional assault rifle having a barrel 12 and a butt 14. Firearm 10 has a firing mechanism 16 operatively connected to a trigger 18 located between the barrel 12 and the butt 14. Firing mechanism 16 comprises a magazine 20 of ammunition. A trigger hand grip 22 is disposed a distance longitudinally behind the trigger 18. Forward sight 24 extends a distance outwards from the barrel 12. The barrel 12 is circumscribed by a stock 26 configured to receive the hand of an operator. Preferably, stock 26 has a picatinny-type rail 28 affixed to the bottom or integrally molded as part of the stock 26. The term picatinny-type rail 28 refers to a picatinny rail also known as a MIL-STD-1913 rail, STANAG 2324 rail, weaver rail, or tactical rail, which is a bracket used on some firearms in order to provide a standardized mounting platform for accessories and attachments.

A first embodiment of a convertible knife fore grip device 30 of the present invention is shown in FIG. 1 attached to and extending downward from the rail 28. Referring particularly to FIGS. 2-11 and in accordance with the present invention, the convertible knife/fore grip device 30 comprises an attachment member 32, a grip body 34, and a blade 36. The grip body has a first end 38 and a second end 40 defining a longitudinal direction therebetween. Preferably, first end 38 is oriented upwards and second end 40 is oriented downwards when grip body 34 is connected to rail 28. The grip body 34 is generally cylindrical in shape and has a substantially circular cross-section. The grip body 34 has an inner surface 42 and an outer surface 44. The grip body 34 is at least partially hollow in which the inner surface 42 defines a chamber 46. Grip body 34 forms a blade passage in the first end 38 aligned with chamber 46. The outer surface 44 can be knurled, striated, ribbed or otherwise shaped in a manner to provide an ergonomic grip to a user's hand when the user grips the grip body 34 with their palm and fingers. A first mounting notch 50 is formed in the first end of grip body 34. Preferably, the grip body 34 is configured to attach to the rail 28 of the firearm 10 oriented in a perpendicular or vertical manner along its longitudinal axis and positioned forwardly of the trigger 18. However, the grip body 34 may be attached to the rail in a manner such that the grip body 34 is in a non-perpendicular or angled relationship with the rail 28. When the device 30 is attached to the rail 28 the blade 36 is stored or otherwise completely housed within the chamber 46 so that no portion of the blade 36 is exposed to prevent injury to the user or otherwise capable of being accessed by a user.

Figure 2:
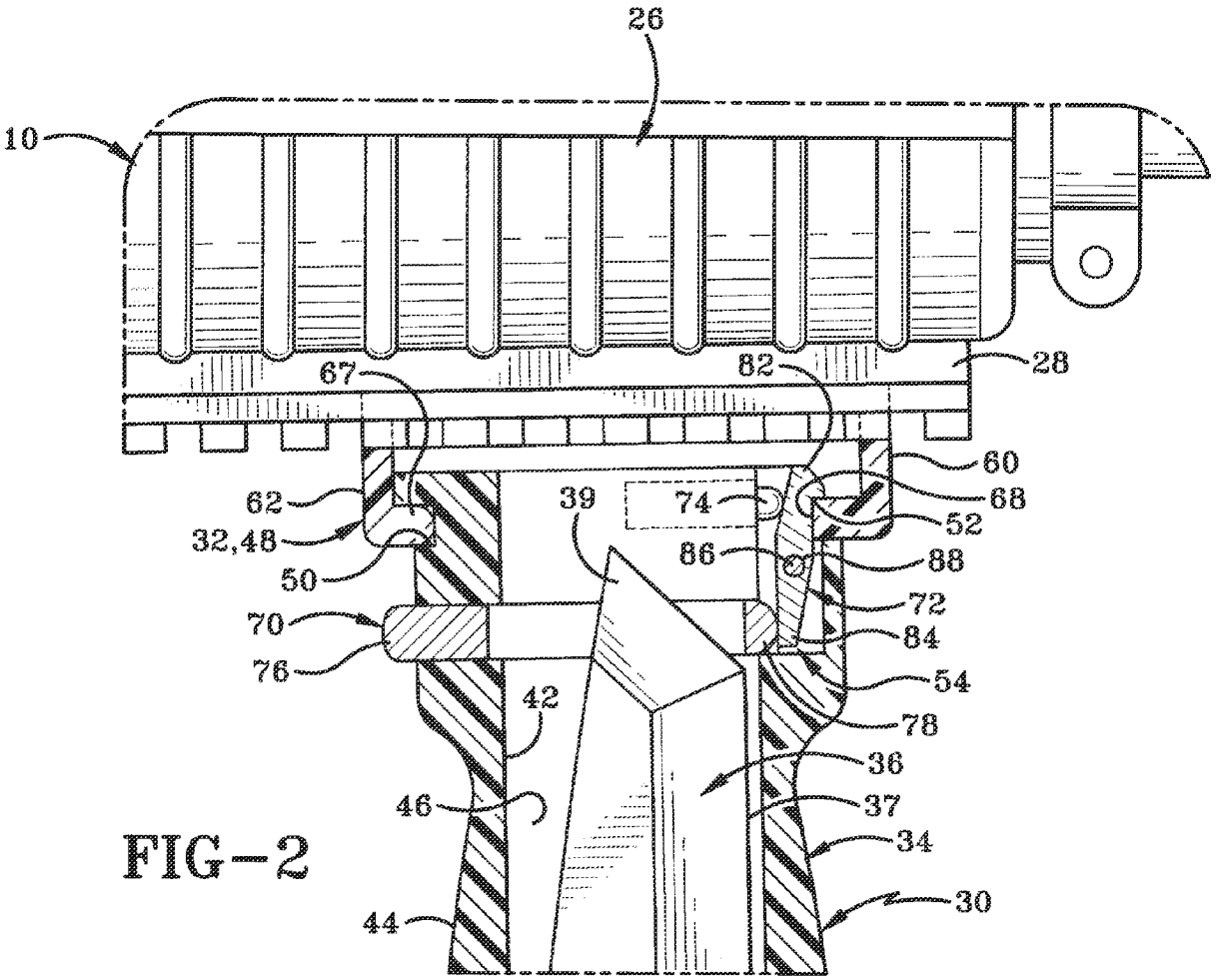
FIG. 2 is an enlarged cutaway section view of the convertible knife/fore grip attached to the rail of the stock.
Figure 3:
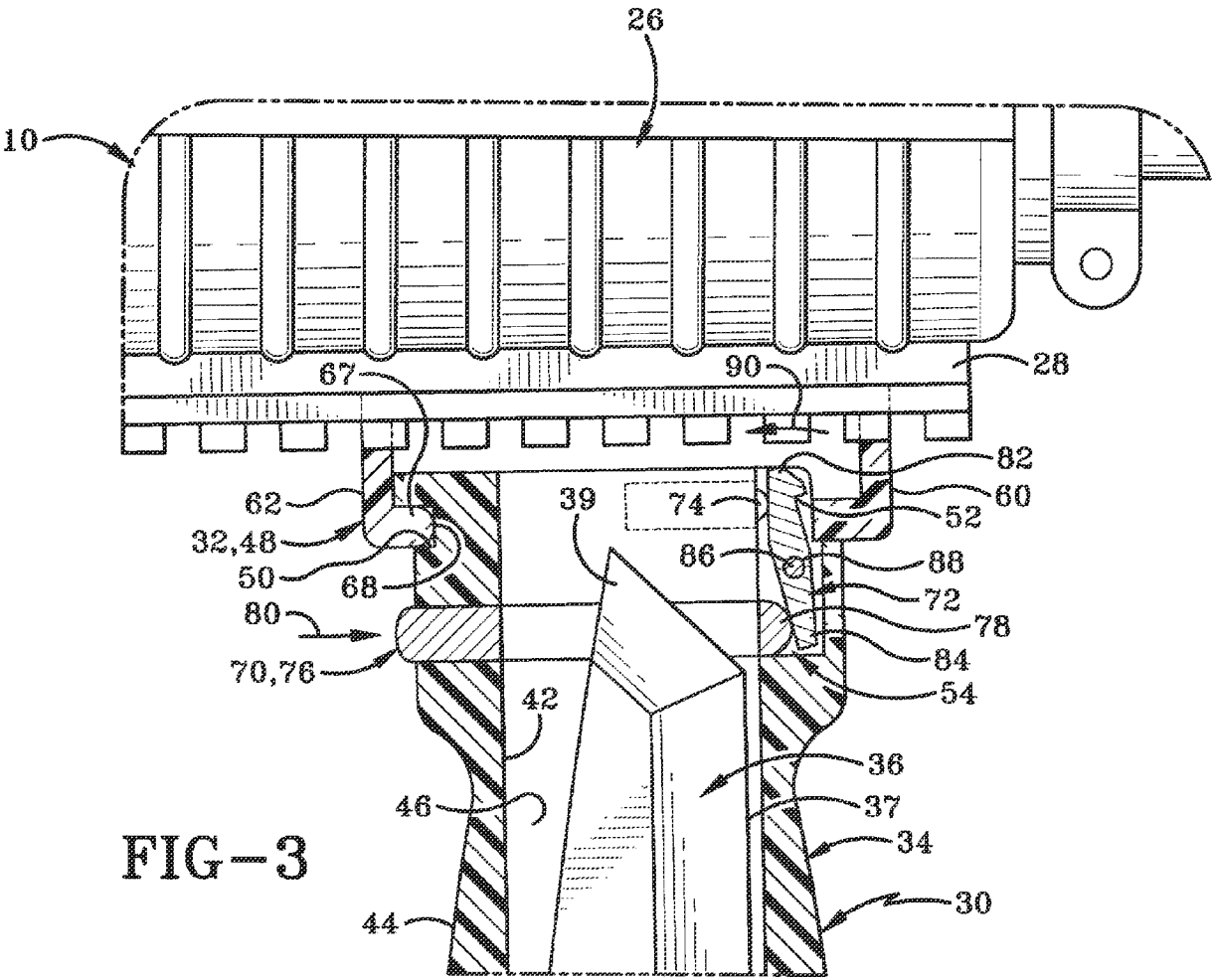
FIG. 3 is an enlarged cutaway section view, similar to FIG. 2, of the convertible knife/fore grip disconnecting from the rail of the stock.

As shown in FIGS. 2-3, the firearm attachment member 32 connects knife device 30 to firearm 10 and extends along its longitudinal axis from adjacent the first end 38 or the top of the grip body 34. The attachment member 32 comprises a coupler 48 and a securing mechanism 54. Coupler 48 is generally configured having two longitudinally spaced apart sidewalls 56, 58, a first end wall 60, a second end wall 62, and a bottom wall 67 (FIG. 5A). A pair of wedge or dove-tail shaped mounting ledges 64, 66 extends longitudinally along the sidewalls 56, 58 from first end 60 to second end 62. Mounting ledges 64, 66 slidably receive rail 28 therein to secure coupler 48 to rail 28. Bottom wall 67 defines a coupling aperture 68 located adjacent the bottom of coupler 48.

Securing mechanism 54 has a push pin member 70, a notch lever 72, and a biasing member 74. Securing mechanism 54 is positioned in a right angle cut out formed within the first end 38 of the grip body. Push pin member 70 preferably is an elongated member having first and second ends 76, 78. Preferably, first end 76 communicates with and extends a distance rearwardly outward from the grip body 34 forming a push pin configured to be depressed by an operator's thumb. An operator depresses the push pin first end 76 to move the push pin member in a linear transverse direction as shown by arrow 80. Notch lever 72 comprises a first end 82, a second end 84, and a pivot pin 86. A second mounting notch 52 is formed in the first end 82 of lever 72. Second end 78 contacts the notch lever 72 at the second end 84. A pivot aperture 88 is formed between the first and second ends 82, 84 for receiving pivot pin 86 therein enabling lever 72 to move between a latched position as shown in FIG. 2 and an unlatched position shown in FIG. 3 along the direction of arrow 90. Biasing member 74 is preferably a coil compression spring and contacts first end 76. Spring 74 urges notch lever 72 to rotate toward the latched position in the pivotable direction opposite to directional arrow 90. Push pin member 70 permits blade 36 the pass through or closely adjacent member 70 as blade 46 transitions from a stored position to an extended position.

An edge of the coupling aperture 48 is received by the first mounting notch 50 and second mounting notch 52 when the device 30 is in the latched position connected to firearm 10. First mounting notch 50 is positioned rearwardly of the second mounting notch 52. First mounting notch 50 operatively receives the second end 62 rear edge of the coupling aperture 68 in a nesting relationship. Second mounting notch 52 connects in a nesting relationship with an edge of the coupling aperture 68.

Figure 4:
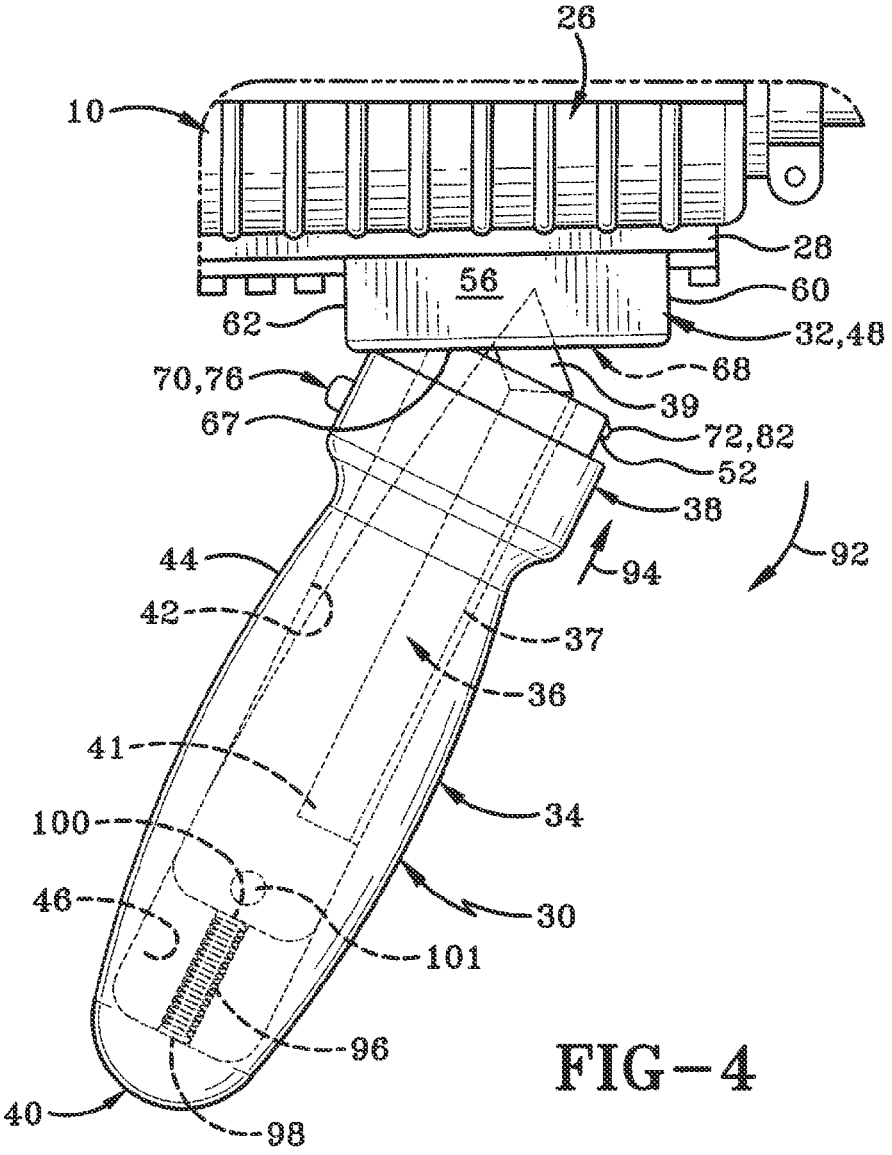
FIG. 4 is an elevation view of the convertible knife/fore grip disconnecting from the rail of the stock.
Figure 5:
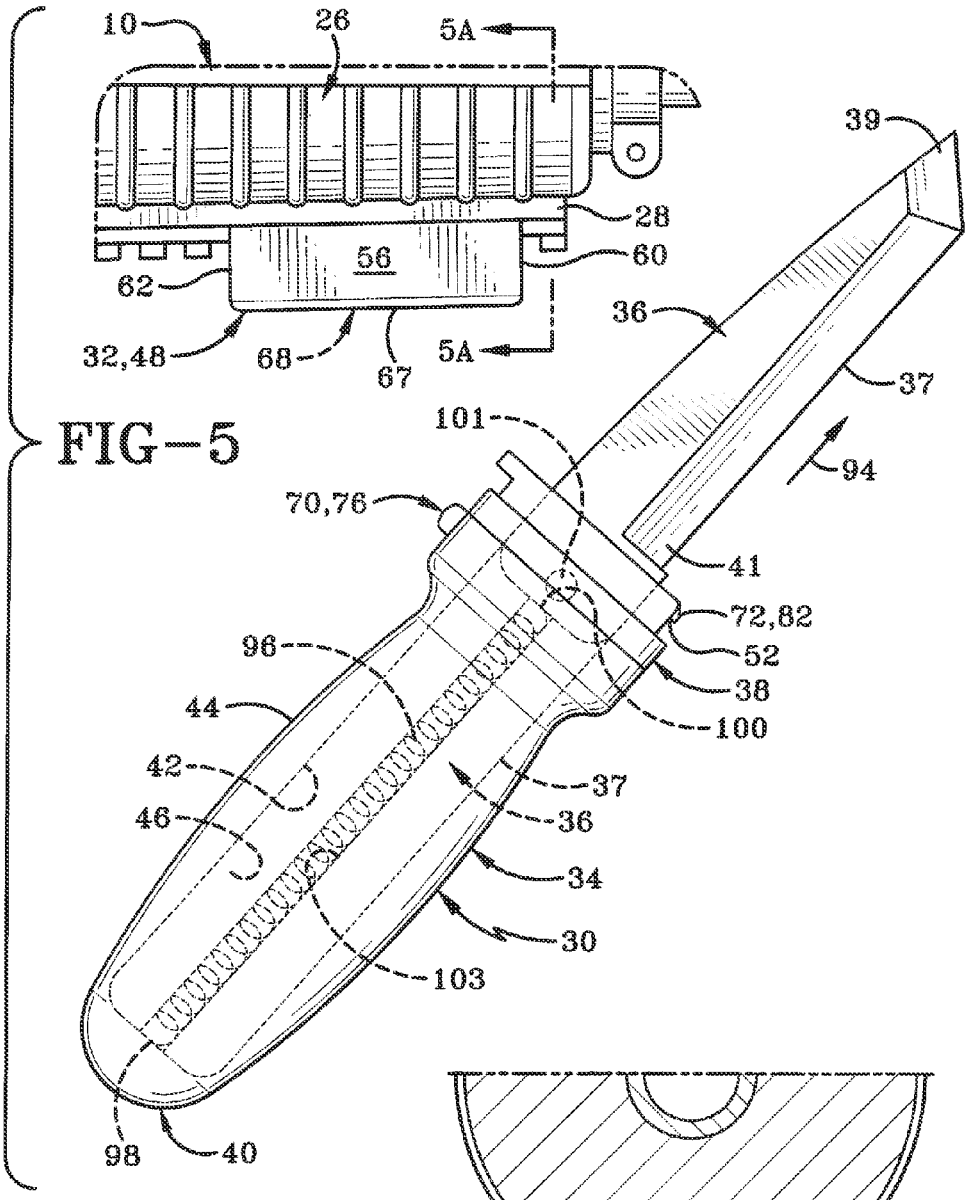
FIG. 5 is an elevation view of the convertible knife/fore grip detached from the firearm and the blade in the extended position.
Figure 5A:
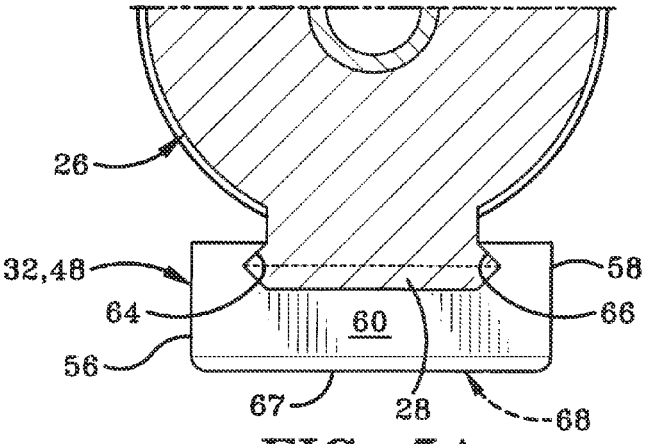
FIG. 5A is an enlarged cross sectional view taken along line 5A-5A of FIG. 5 detailing the coupler attached to the rail.

With primary reference to FIGS. 4-5A, device 30 is released from the connection with coupler 48 by depressing push pin member 70 enabling grip body 34 to be removed along directional arrow 92. An urging member 96 operatively connects blade 36 to grip body 34 between stored and extended positions. Urging member 96 attaches to the grip body 34 at the first end 98 and attaches to blade 36 at the second end receiving seat 100. Alternatively, urging member 96 may be affixed to a stud 101. Stud 101 travels within a channel or grove 103 formed in the grip body 34 on each side of the blade 36 extending from first end 38 to second end 40. Stud 101 extends outward from each side of blade 36 and is disposed within the channel 103 on each side of the blade 36. Stud catches an end of the channel to prevent blade 36 from being urged out of the grip boy by urging member 96. When the device 30 is vertically connected to the firearm 10, the urging member is compressed as shown in FIG. 4 and the blade 36 is housed within the chamber 46. When the device 30 is disconnected from the firearm 10, the urging member 96 biases blade 36 vertically outward along its longitudinal axis as shown in FIG. 5 from the first end 38 of the grip body 34 through the blade passage in the direction of arrow 94.

The blade 36 is convertible between an extended position and a stored position operatively connected to the grip body 34. A blade lock (not shown) as conventionally known in the art may be operatively connected to the blade 34 and the grip body 36 so that the lock can secure the blade in its extended or stored position. The blade lock may be selectively unlocked or locked by an operator. The blade has a conventional edge 37 and may be either serrated or non-serrated. The edge 37 extends from a first end or tip 39 to a second end or base 41.

Figure 7:
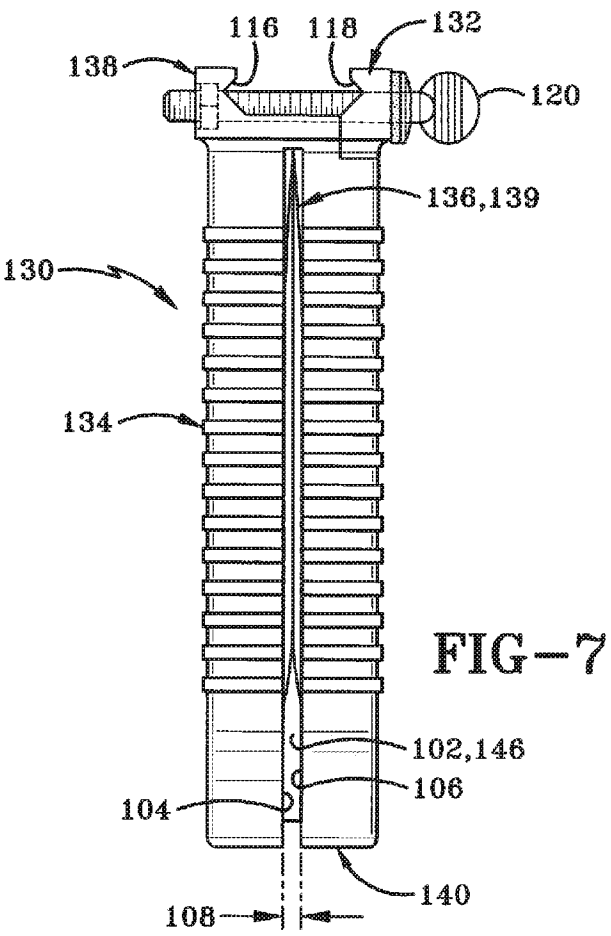
FIG. 7 is a side elevation view of the second embodiment looking in the direction of arrows 7-7, of FIG. 6.
Figure 6:
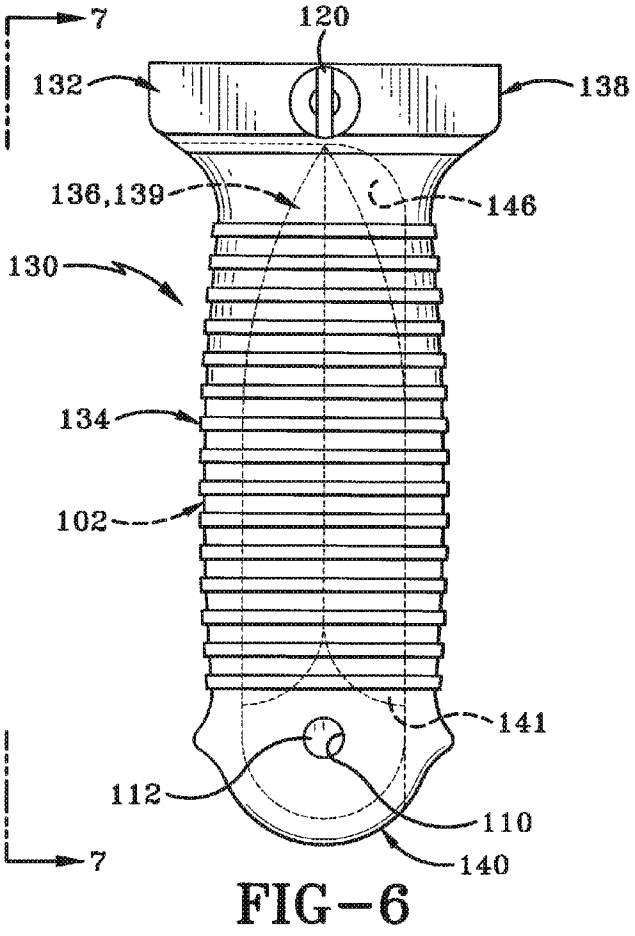
FIG. 6 is a frontal elevation view of a second embodiment of the present invention showing the blade in the stored position.
Figure 8:
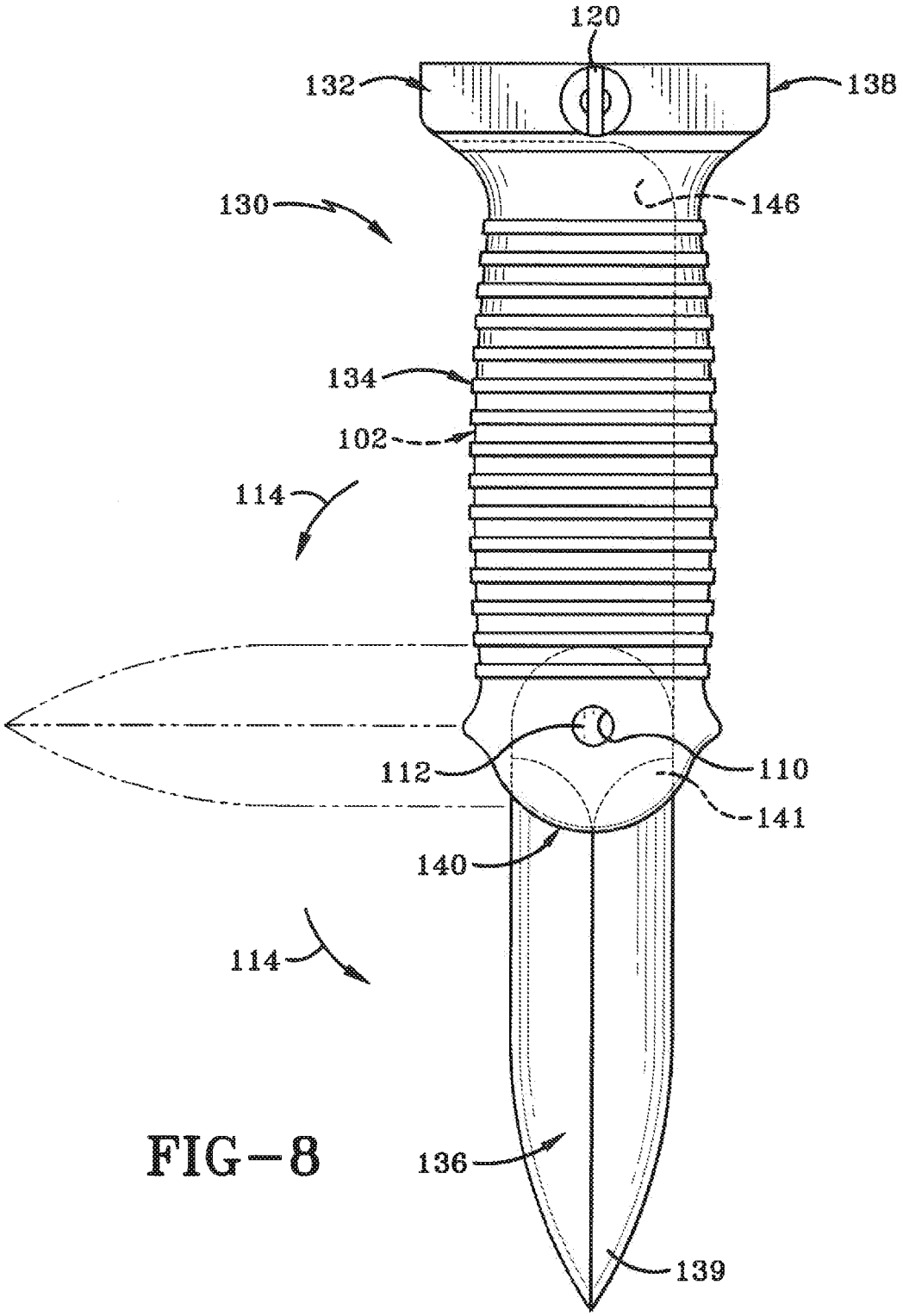
FIG. 8 is an elevation view of the second embodiment of FIGS. 5 and 6 showing the blade in the extended position.

A second embodiment of the convertible knife fore grip device 130 is shown in FIGS. 6-8 and includes a substantially cylindrical grip body 134 defining a slit passage 102 which extends along the longitudinal axis of the grip body from a first end 138 to a second end 140. Slit passage is defined by a first slit edge 104 and a second slit edge 106 defining a slit width 108 therebetween. The slit passage 102 is linearly aligned with a chamber 146 formed within grip body 134 so that the blade 136 exits slit passage 102 when selectively desired by the operator. The slit passage 102 permits the blade to convert between an extended position, as shown in FIG. 8, and a stored position, as shown in FIGS. 6-7.

A pivot pin 112 located adjacent the second end 141 of the blade 136 operatively connects the blade 136 to the grip body 134 through aperture 110. The pivot pin 112 permits a pivotable rotation of the blade 136 along rotationally directional arrow 114 between the extended and the stored positions. After pivotably rotating the blade from the stored to the extended position, preferably after removing grip body 134 from the tactical rail 28, a user may lock the blade in place in the extended position by engaging the blade lock (not shown). This embodiment of device 130 provides a blade that is positioned longitudinally, and rotates in the direction of arrow 114 about pivot pin 112 in a manner such that when blade 136 is in the extended position, tip 139 faces downwards. Pivot pin 112 extends transversely across grip body 34 adjacent the second end 140.

Second embodiment 130 includes an attachment member 132 formed with a first mounting notch 116 spaced apart and opposed a second mounting notch 118 wherein the first and second mounting notches 116, 118 removably secure the convertible knife device 130 to the picatinny rail 28 of the firearm 10. The attachment member 132 further includes a releasable securing mechanism 120, shown as a thumbscrew to clamps the two notches to the rail 28. The securing mechanism 120 may also be a clamp, spring closure, Allen screw or another known securing mechanism as would be understood in the art.

Figure 10:
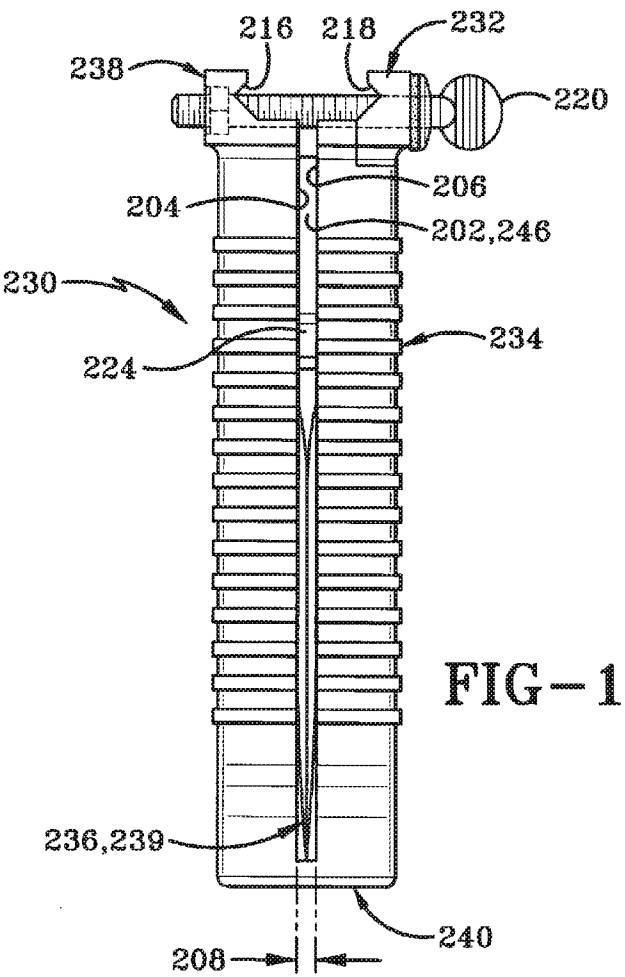
FIG. 10 is a side elevation view of the third embodiment looking in the direction of arrow 10-10, of FIG. 9.
Figure 9:
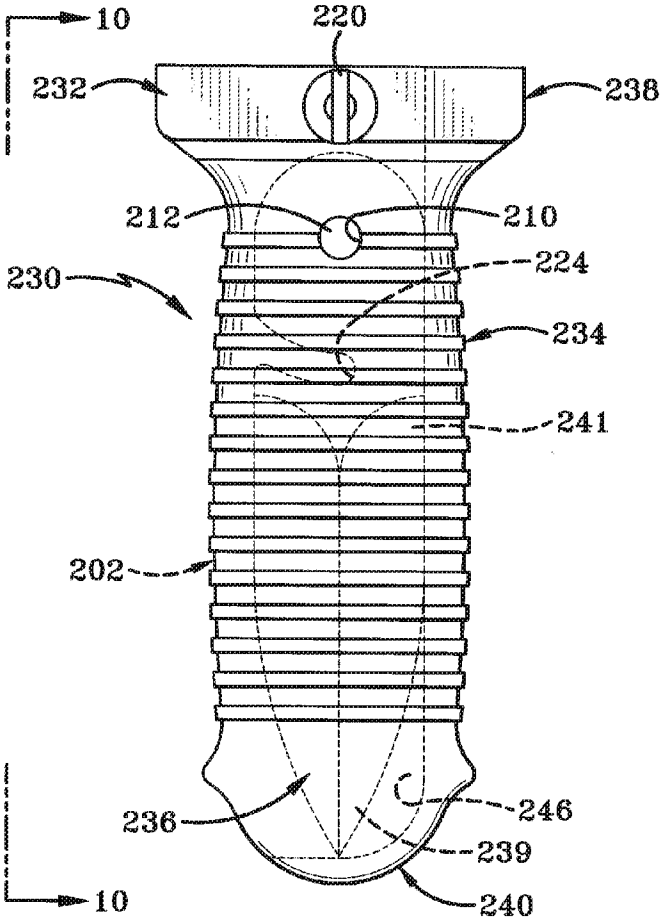
FIG. 9 is a frontal elevation view of a third embodiment of the present invention showing the blade in the stored position.
Figure 11:
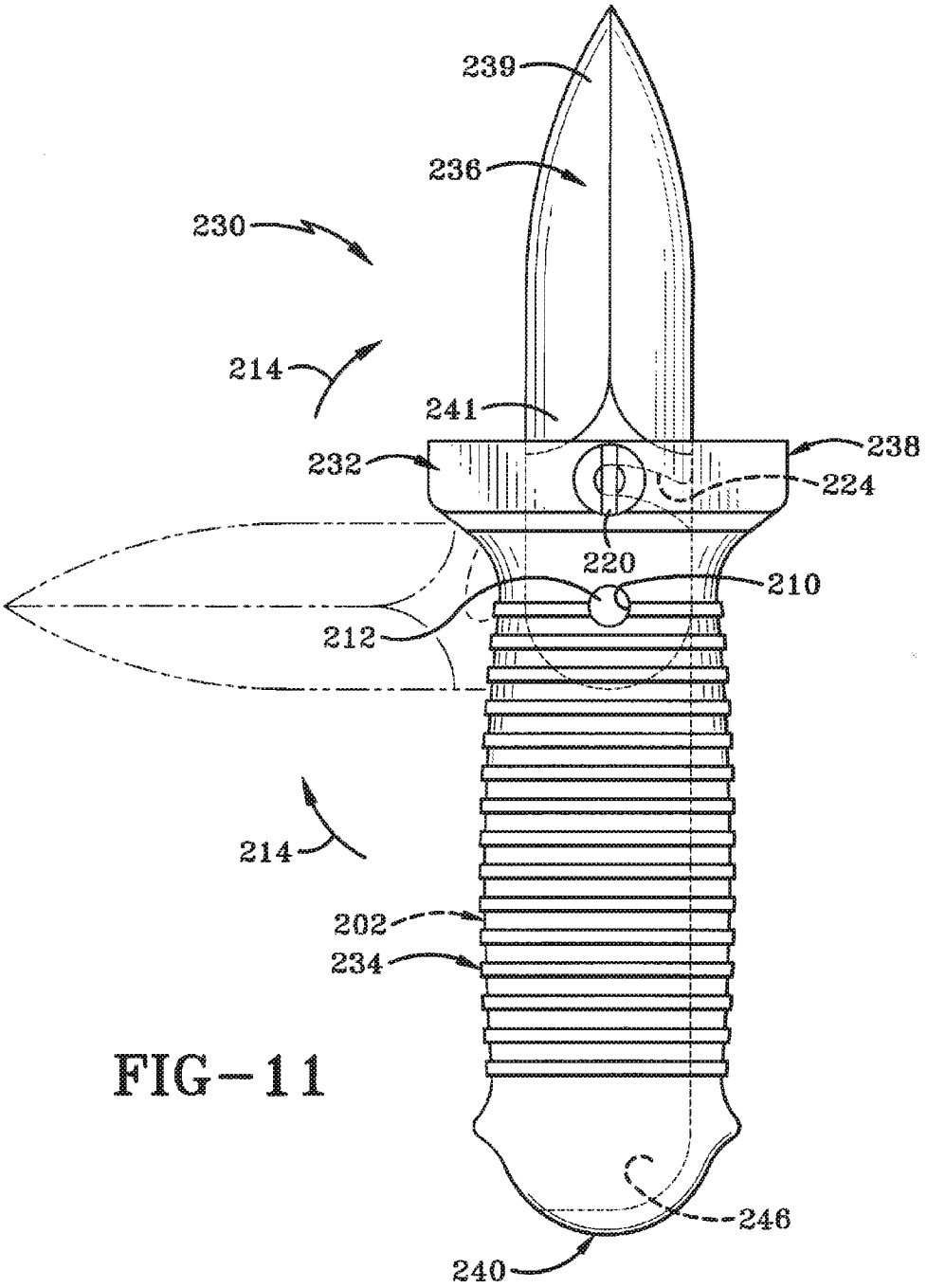
FIG. 11 is an elevation view of the third embodiment of FIGS. 9 and 10 showing the blade in the extended position.

A third alternate embodiment of the present invention as shown in FIGS. 9-11 provides a convertible knife/fore grip assembly 230 having a blade 236 that is positioned longitudinally within a chamber 246, and rotates in the direction of arrow 214 about pivot pin 212 in a manner such that when blade 236 is in the extended position, tip 239 faces upwards. Pivot pin 212 extends transversely across grip body 234 adjacent the first end 238. Blade 236 defines a channel 224 configured to receive and communicate with securing mechanism 220 of attachment member 232.

Cylindrical grip body 234 defines a slit passage 202 which extends longitudinally along the grip body from first end 238 to second end 240. Slit passage is defined by a first slit edge 204 and a second slit edge 206 defining a slit width 208 there between. The slit passage 202 is linearly aligned with the chamber 246 so that the blade 236 may exit slit passage 202 when selectively desired by the operator. The slit passage 202 permits the blade to convert between an extended position (i.e. a knife) and a stored position (i.e. a fore grip).

Located adjacent the second end 241 of the blade 236 may be an aperture 210 defined by the blade. The aperture 210 is designed to receive a pivot pin 212 which operatively connects the blade 236 to the grip body 234. The pivot pin 112 permits a pivotable rotation of the blade 236 along rotationally directional arrow 214 between the extended and the stored position. After pivotably rotating from the stored to the extended position, a user may lock the blade in place in the extended position by engaging the blade lock (not shown).

Attachment member 232 comprises a first mounting notch 216 spaced apart and opposed a second mounting notch 218 wherein the first and second mounting notches 216, 218 removably secure the convertible knife device 230 to the picatinny rail 28 of the firearm 10. The attachment member 232 further comprises a releasable securing mechanism 220 which clamps the two notches to the rail. The securing mechanism 220 may be a clamp, spring closure, thumbscrew, Allen screw or another known securing mechanism as would be understood in the art.

Preferably, the grip body of the device convertible between a knife and a firearm fore grip is molded from a hardened plastic or polymer, such as polyethylene or polypropylene, however other materials may be utilized. An alternate material that may be used to mold the grip body is a para-aramid synthetic fiber. One exemplary para-aramid material is Kevlar® manufactured by the E. I. du Pont de Nemours and Company of Wilmington, Del. The blade preferably is made from stainless steel, however, clearly other conventionally known blade compositions, such as titanium, hardened steel, or the like, may be utilized.

While the term vertical is used throughout this application for orientation purpose, it is to be understood that alternative alignments are possible, such as horizontal or angled. Further, the term vertical means aligned with the longitudinal axis, the blade itself may point up or down, as long as it is aligned longitudinally. Further, design variance allow for the grip body to be attached to the firearm by conventionally known connection devices, such as a clamp, to be used with firearms that do not have a tactical rail.

In operation, the device convertible between a knife and a firearm fore grip has an extended or knife position and a stored or grip position. The device is connected to a rail of the stock connected to the firearm. To release the device from the firearm, a user grasps the grip body with their hand. Using one finger, preferably the thumb, user depresses the push pin member. Push pin member is operatively connected to the releasable securing mechanism such that when the push pin member is depressed, the securing mechanism releases grip body from its connection with the firearm. As the grip body is pulled away by the user from the firearm, the blade extends through or pivotably moves from the chamber that the blade was housed within while in the stored position. The blade may be selectively locked in the extended position by operator. Operator uses knife for a desired purpose, such as cutting a desired item. The grip body remains attached to the blade at all times. The blade is then retracted or positioned back into the stored position within the chamber. When finished with the knife, operator attaches the knife back to the rail.

In one embodiment, operator aligns the tip of blade with coupler. Operator applies force to the grip body in a manner causing the blade to retract within the chamber into its stored position. One exemplary application of force provides the tip contacting the coupler and operator applying force in the upward vertical direction. The upward vertical force causes the blade that is contacting coupler at its tip to move relationally downward into the chamber. Operator then attaches grip body to coupler by securing mounting notches to the edges of the couple aperture to effectively lock blade into the stored position.

In another embodiment, operator pivotably closes blade through the slit passage and locks it into the stored position. Attachment member may then be connected to the rail.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the invention are an example and the invention is not limited to the exact details shown or described.

The invention claimed is:

1. A grip for a firearm comprising:

a grip body having first and second ends, the grip body removably mounted on a firearm positioned forwardly of a trigger, the grip body defining an interior chamber;

a firearm attachment member on the first end of the grip body, wherein the attachment member includes:

a coupler adapted to connect the grip body to a rail on the firearm; and a releasable securing mechanism mounted in the grip body adjacent the first end adapted to releasably secure the grip body to the coupler; and a blade located within the interior chamber of the grip body and moveable between a stored position and an extended position.

2. The device of claim 1, wherein the blade extends outward from adjacent one of the first and second ends of the grip body when the blade is in the extended position.

3. The device of claim 1, including a pivot pin attached to the grip body adjacent one of the first and second ends and to the blade through an aperture formed in the blade to pivotably mount the blade within the interior chamber.

4. The device of claim 1, including an urging member operatively connected between the grip body and the blade for biasing the blade toward the extended position.

5. The device of claim 4, wherein the urging member is a compression coil spring operatively connected to the grip body adjacent the second end within the chamber;

wherein a blade passage is formed in the first end of the grip body and aligns with the chamber; and wherein the spring biases the blade to the extended position through the blade passage upon removal of the grip body from the firearm.

6. The device of claim 1, wherein a stud extends through the blade and is received in a channel formed in the grip body permitting the blade to remain operatively affixed to the grip body when the device is disconnected from a tactical rail of the firearm.

7. The device of claim 1, wherein a slit passage is formed in the grip body and extends between the first and second ends and aligns with the chamber; and wherein the blade pivotably moves through the slit passage as the blade moves between the extended position and the stored position.

8. The device of claim 1, wherein the grip body is generally cylindrical and formed at least partially of a composite plastic.

9. The device of claim 1, wherein the coupler includes a pair of dove-tail mounting edges extending from a coupler first end to a coupler second end for slidably receiving the rail.

10. A grip for a firearm comprising:

a grip body having first and second ends adapted to be removably mounted on a firearm, the grip body defining an interior chamber;

a firearm attachment member on the first end of the grip body; and a blade located within the interior chamber of the grip body and moveable between a stored position and an extended position, wherein the attachment member includes:

a coupler adapted to connect the grip body to a rail on the firearm; and a releasable securing mechanism mounted in the grip body adjacent the first end adapted to releasably secure the grip body to the coupler, wherein the securing mechanism further comprises:

a push pin having first and second ends adapted to be engaged by an operator to unlatch the securing mechanism from the coupler;

a lever having first and a and second ends, wherein the second end of the lever is in communication with the second end of the push pin member; and a biasing member biasing the lever into a latching engagement with the coupler.

11. A grip for a firearm comprising:

a grip body having first and second ends adapted to be removably mounted on a firearm, the grip body defining an interior chamber;

a firearm attachment member on the first end of the grip body; and a blade located within the interior chamber of the grip body and moveable between a stored position and an extended position;

wherein the attachment member includes:

a coupler adapted to connect the grip body to a rail on the firearm; and a releasable securing mechanism mounted in the grip body adjacent the first end adapted to releasably secure the grip body to the coupler, wherein the securing mechanism further comprises:

a push pin having first and second ends adapted to be engaged by an operator to unlatch the securing mechanism from the coupler;

a lever having first and second ends, wherein the second end of the lever is in communication with the second end of the push pin member; and a biasing member biasing the lever into a latching engagement with the coupler; and a first mounting notch formed in the first end of the grip body; and a second mounting notch formed on the first end of the lever, wherein the first and second mounting notches removably receive a portion of the coupler to releasably secure the coupler to the grip body.

12. In combination, a firearm having a tactical rail and a fore grip, wherein the fore grip includes:

a grip body having first and second ends positioned forward of a trigger and removably mounted on the rail of the firearm, the grip body defining an interior chamber;

an attachment member on the first end of the grip body attaching the grip body to the tactical rail wherein the attachment member includes:

a coupler operatively connecting the grip body to the tactical rail;

a securing mechanism mounted in the grip body operatively connecting the grip body to the coupler;

a first mounting notch formed in the first end of the grip body;

a second mounting notch formed in the securing mechanism; and wherein the first and second mounting notches removably receive a portion of the coupler therein to removably mount the grip body on the tactical rail; and a blade located within the interior chamber of the grip body and moveable between a stored position and an extended position.

13. The combination of claim 12, wherein a slit passage is formed in the grip body aligned with the interior chamber to enable the blade to move through the slit passage as the blade extends outward from adjacent one of the first end and the second end of the grip body when the blade is in the extended position.

14. The combination of claim 12, wherein the blade, when within the interior chamber, extends along a longitudinal axis of the grip body that is generally perpendicular to the rail when the fore grip is attached to the firearm.

15. The combination of claim 12, wherein the blade, when within the interior chamber, extends along a longitudinal axis of the grip body that is non-perpendicular to the rail when the fore grip is attached to the firearm.

16. The combination of claim 12, wherein the blade and grip body remain operatively connected when the fore grip is disconnected from the firearm.

17. The combination of claim 12, wherein the fore grip is generally perpendicular to a longitudinal axis of the tactical rail when removably mounted thereon.

* * * * *